US005799456A

United States Patent [19]

Shreiner et al.

[11] Patent Number: 5,799,456

[45] Date of Patent: Sep. 1, 1998

[54] EXPANSION JOINT COVER INSTALLATION

[75] Inventors: Thomas A. Shreiner, Picture Rocks; Roger W. Barr, Williamsport, both of Pa.

[73] Assignee: Construction Specialties, Inc., Cranford, N.J.

[21] Appl. No.: 867,476

[22] Filed: Jun. 2, 1997

[51] Int. Cl.[6] ..... E04B 1/68

[52] U.S. Cl. ..... 52/396.04; 52/573.1

[58] Field of Search ..... 52/396.04, 573.1, 52/167.1, 396.08, 396.09, 393, 465, 459, 396.06, 396.03, 396.05; 404/47, 67, 68

[56] References Cited

U.S. PATENT DOCUMENTS

| | | | |
|---|---|---|---|
| 5,048,249 | 9/1991 | Shreiner et al. | 52/403 |
| 5,078,529 | 1/1992 | Moulton . | |
| 5,357,727 | 10/1994 | Duckworth et al. | 52/396.06 |
| 5,365,713 | 11/1994 | Nicholas et al. | 52/573.1 |
| 5,611,181 | 3/1997 | Shreiner et al. . | |
| 5,644,879 | 7/1997 | Shrein et al. | 52/393 |
| 5,666,775 | 9/1997 | Shreiner et al. | 52/396.04 |

*Primary Examiner*—Beth A. Aubrey

*Attorney, Agent, or Firm*—Baker & Botts, L.L.P.

[57] ABSTRACT

An expansion joint cover installation includes first and second building members defining an expansion gap between them and a cover member spanning and covering the gap and engaging the building members. The cover member is held centered in the gap by a resilient centering system that is coupled between the building members and the cover member and includes a plurality of first tensioned flexible segments connected obliquely between the first building member and the cover member and a plurality of second tensioned flexible segments connected obliquely between the second building member and the cover member. By arranging the tensioned segments obliquely to the axis of the gap, they are relatively long and are able to provide an adequate centering force over a relatively large range of motion between open and closed states of the gap. Advantageously, the system includes two first tensioned flexible segments and two second tensioned flexible segments extending mutually divergently from a common cover connection point at substantially the lateral center of the cover member at substantially equal angles with the longitudinal axis of the cover member and maintained under substantially equal tension with the cover member centered in the gap.

29 Claims, 8 Drawing Sheets

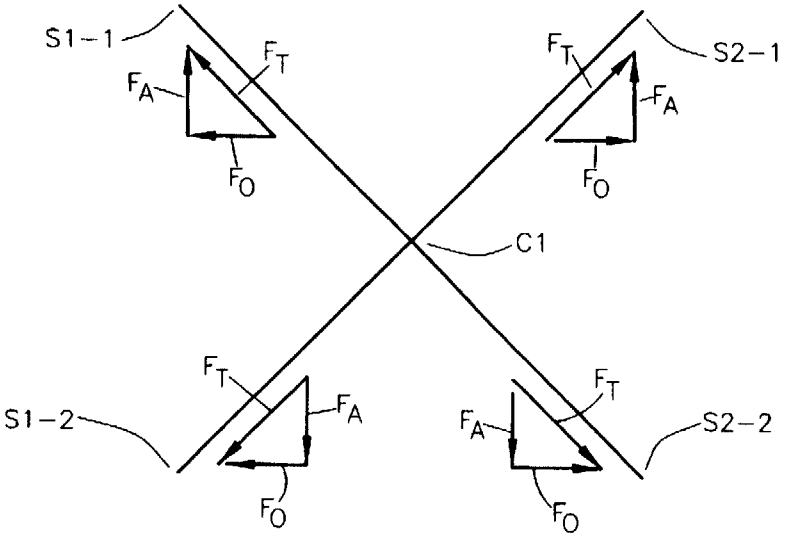
FIG. 4
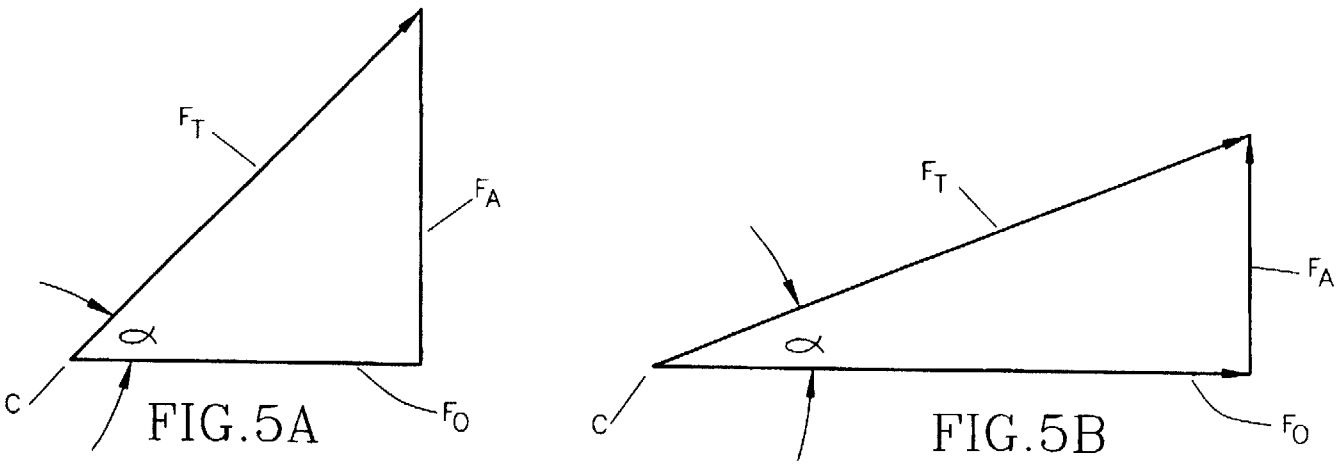
FIG.5A
FIG.5B

EXPANSION JOINT COVER INSTALLATION

BACKGROUND OF THE INVENTION

Expansion joint covers of various designs are available for spanning and covering the gaps at expansion joints between adjoining building structures where corridors and rooms extend across the joints and at the outside walls. Common to most designs is a cover member that is coupled to the building structures on the opposite sides of the gap, usually by means of retainers, in a manner that permits the building structures to move relative to each other and to one or both side edges of the cover. In some systems, the cover is affixed to a retainer on one side of the gap and movable relative to a retainer on the other side of the gap. Alternatively, the cover may be retained in a manner that allows movements of both building structures relative to it. In some designs, it is desirable or necessary that the cover be held centered in the gap.

A common way of keeping the cover centered is by means of a series of bridge bars, which extend across the gap obliquely to the axis of the gap, have their opposite ends retained by guides on the retainers that keep the ends fixed transversely to the gap while allowing them to slide parallel to the axis of the gap, and are pivotally attached at their centers to the center of the cover. The bridge bars rotate about the pivot connections to the cover to different angles, relative to the gap axis, as the expansion joint opens and closes, while the pivot axes of the bridge bars, and therefore the cover, remain centered in the gap.

Bridge bars are costly to provide and install. In some designs that are intended for use in buildings in earthquake zones, bridge bars are not capable of sustaining without severe damage the large relative movements of the structures on opposite sides of the expansion joint that occur in an earthquake, and their presence can contribute to damage to the structures adjacent the expansion gaps. Many seismic expansion joint systems have to be completely replaced after even a relatively moderate earthquake.

Expansion joint cover systems designed for use where the relative movements of the building structures on opposite sides of the expansion joints are small often use some type of spring system, such as metal W-springs or leaf springs, to keep a cover centered. Conventional spring systems cannot be used where large movements of the structures are expected, inasmuch as springs of a suitably small size for practical and economical use in an expansion gap cannot extend and retract a large enough distance to accommodate large movements while exerting an adequate centering force in all possible widths of the gap.

SUMMARY OF THE INVENTION

One object of the present invention is to provide an expansion joint installation that provides for maintaining a cover member centered transversely of the expansion gap over a relatively wide range of relative motions of the building structures on opposite sides of the expansion gap, including motions resulting from relatively severe seismic events and motions in all directions. Another object is to provide an expansion joint installation that is economical to produce and install. Still a further object is to provide a centering system for an expansion joint cover that exerts an adequate centering force on a cover member throughout a wide range of magnitudes and directions of relative motions of the building structures on opposite sides of expansion joints. It is also an object of the invention to provide a capability for the cover member to be released from engagement with the building structures but still be retained by a resilient centering system such that, for example, a cover member that is released cannot fall from a wall or ceiling onto the floor and become an obstacle to persons crossing the expansion joint—thus, the centering system also functions as a tethering system for a cover member that is designed to release from the building structures in a seismic event.

The foregoing objects are attained, in accordance with the present invention, by an expansion joint cover installation that comprises first and second building members defining an expansion gap between them, the expansion gap having a central axis and being of variable width due to movements of the building members, and a cover member spanning and covering the expansion gap and engaging the building members, the cover member having parallel side edges. The cover member is held centered in the expansion gap by a resilient centering system that is coup led between the building members and the cover member and retains the cover member with its side edges substantially equidistant from the axis of the expansion gap for all widths of the expansion gap. In particular, the resilient centering system includes a plurality of first tensioned flexible segments connected obliquely to the axis of the expansion gap between the first building member and the cover member, and a plurality of second tensioned flexible segments connected obliquely to the axis of the expansion gap between the second building member and the cover member. By arranging the tensioned segments obliquely to the axis of the gap, they are relatively long and are able to provide an adequate centering force over a relatively large range of motion between open and closed states of the expansion gaps. Advantageously, the system includes two first tensioned flexible segments and two second tensioned flexible segments extending mutually divergently from a common cover connection point at substantially the lateral center of the cover member at substantially equal angles to the longitudinal axis of the cover member and maintained under substantially equal tension when the cover member is centered.

Although it is, of course, possible to provide multiple individual tensioned flexible segments connected between the cover and the building members in various ways, it is desirable for the segments to be portions of continuous tensioned flexible members that extend along zig-zag paths between spaced-apart building connection points where they are connected to the building members and spaced-apart cover connection points where they are connected to the cover member. In particular, the first tensioned flexible segments may be portions of a first continuous tensioned flexible member that extends along a zig-zag path between spaced-apart building connection points where the first continuous tensioned flexible member is connected to the first building member and spaced-apart cover connection points where the first continuous tensioned flexible member is connected to the cover member; the second tensioned flexible segments may be portions of a second continuous tensioned flexible member that extends along a zig-zag path between spaced-apart building connection points where the second continuous tensioned flexible member is connected to the second building member and spaced-apart cover connection points where the second continuous tensioned flexible member is connected to the cover member.

In a particularly preferred arrangement, segments of the first and second tensioned flexible members form substantially equal angles with the axis of the expansion gap and are maintained under substantially equal tension for any given width of the expansion gap when the cover member is centered in the gap. Also, the paths of the first and second continuous tensioned flexible members are symmetrical with respect to the axis of the expansion gap when the cover member is centered. Maintaining equal angles, equal tension forces, and symmetry in the centered position of the cover prevents the tensioned segments from exerting any net forces axially of the cover member and thus tending to shift the cover member axially of the gap or exerting loads on the cover member itself in tension or compression; the equal angles and symmetry exert offsetting axial load components on the cover member.

On the other hand, it is possible in a wall expansion joint installation to orient and tension the segments such that they exert a net force on the cover member that offsets part or all of the weight of the cover member. Thus, the term "substantially" is used herein to indicate that variations of angles and tensions of the segments are not only possible but can be beneficial.

Advantageous centering systems, according to the present invention, have a first continuous tensioned flexible member connected alternately with respect to its length to the first building member and to the cover member such as to form at least four segments extending obliquely at substantially equal angles with respect to the axis of the expansion gap between the first building member and the cover member and a second continuous tensioned flexible member connected alternately with respect to its length to the second building member and to the cover member such as to form at least four segments extending obliquely at substantially equal angles with respect to the axis of the expansion gap between the second building member and the cover member, the segments of the first and second tensioned continuous flexible members being oriented substantially symmetrically with respect to the axis of the expansion gap and being retained under substantially equal tensions for any given width of the expansion gap when the cover is centered. With the foregoing arrangement, the cover member is connected to each of the building members by two segments at each of two points spaced apart axially from each other. Accordingly, cocking of the cover member out of axial alignment with the expansion gap is precluded. The desirable force conditions described above also exist.

Examples of tensioned flexible members that can be used in installations according to the present invention include elastic cords, such as elastic cords commonly called "shock cords." The opposite ends of each elastic cord are affixed to either the building members or the cover member. As indicated below, having the ends of the elastic cords fastened to the building members is preferred. A tensioned flexible member may also be composed of a substantially non-elastic strand, such as a synthetic fiber cord or rope or a wire cable, which can be coated or sheathed by a polymeric material, and means for tensioning the strand connected at a suitable location in the path of the strand, preferably between one end of the strand and a building member. The strands are movably connected to the building member and the cover member at the ends of each segment except for an affixed end and the tensioned end. The tensioning means used with an essentially non-extensible strand may be a tension spring, such as a metal coil spring, a shock cord, which can be doubled to increase its tension force, a weight, or a pneumatic device, such as a gas spring.

The expansion joint installation of the present invention can be used with rigid cover members of any suitable construction. An advantageous cover member for walls and ceilings is a panel of a fiber-reinforced resin, which is light in weight and yet rigid and durable and also has good acoustical properties. Rigid cover members are, of course, coupled to the building members in a sliding relationship orthogonally of the gap axis, which can be accomplished in various ways. For example, a rigid cover member may be fitted with at least two transverse tracks spaced apart longitudinally with respect to the axis of the expansion gap, two slide members slidably received in each track, and releasible fasteners having one element attached to each slide member and another element affixed to a corresponding building member.

The installation may also be used with extensible cover members, such as one or more panels of a flexible polymeric material having pleats or corrugations extending substantially parallel to the axis of the expansion gap and affixed along its side edges to the respective building members, usually by means of retainers.

When an expansion joint cover installation, according to the present invention, is used in a floor joint, the tensioned flexible members must exert forces on the cover member that are sufficiently high to prevent the cover from moving when persons walk across it or carts or other objects are moved across it. Steel cables, tensioned by strong mechanical or pneumatic springs or heavy weights, are preferred for floor joints.

For a better understanding of the present invention, reference may be made to the following description of exemplary embodiments, taken in conjunction with the accompanying drawings.

DESCRIPTION OF THE DRAWINGS

FIG. 4 is a diagram showing a typical group of tensioned segments and the force components they exert on a cover member connection point;

FIGS. 5A and 5B are vector diagrams of the force components of a tensioned segment acting at different angles;

DESCRIPTIONS OF THE EMBODIMENTS

Figure 2:
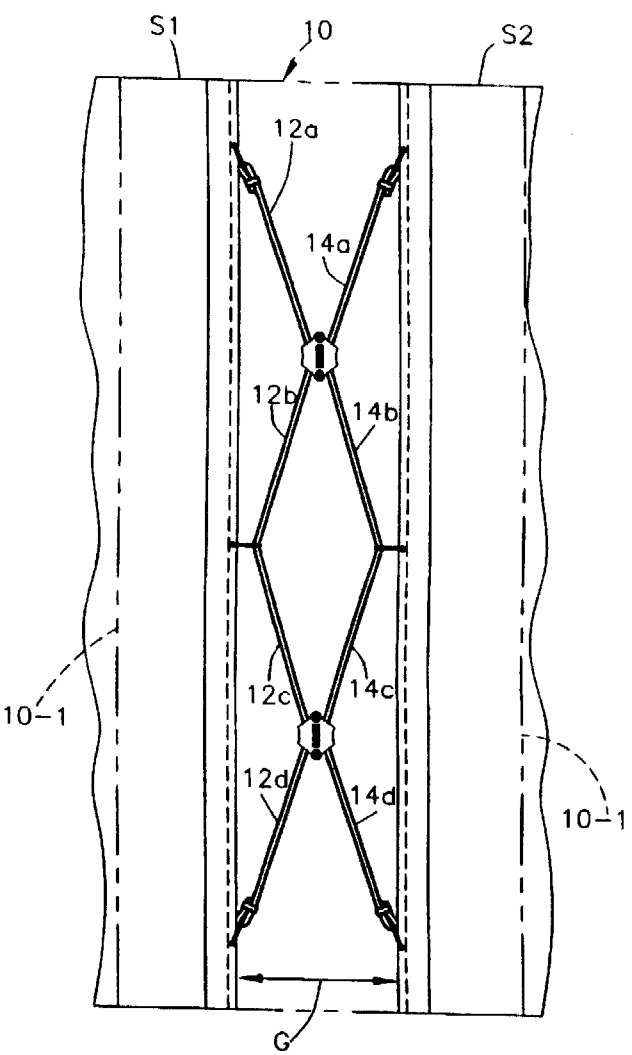
FIG. 2 is an elevational view of the expansion joint installation of FIG. 1, but showing the gap closed.
Figure 1:
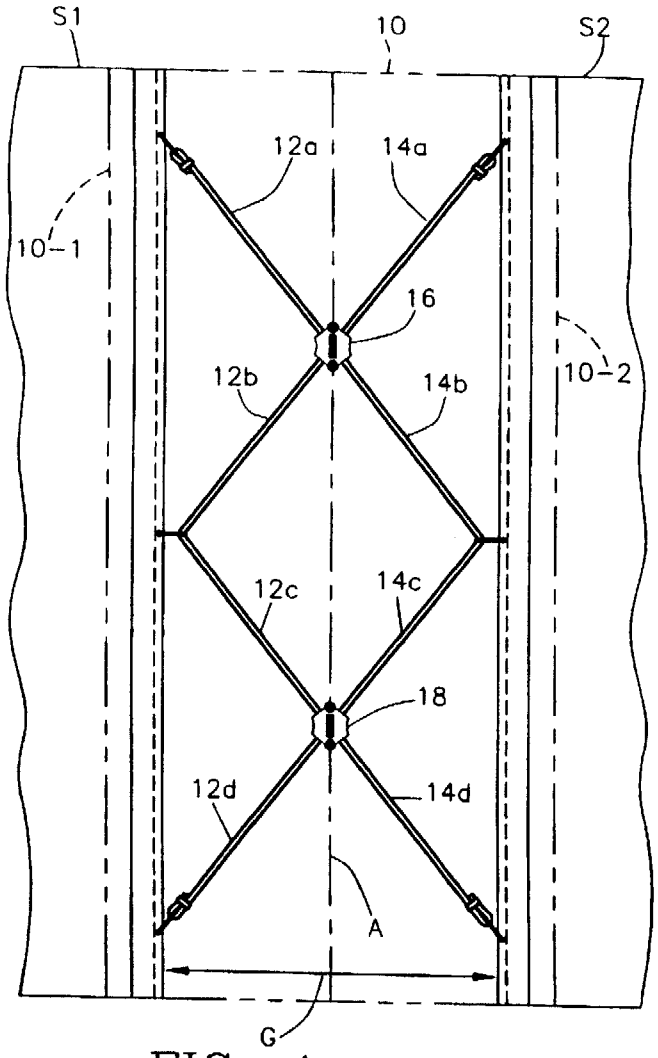
FIG. 1 is an elevational view of an expansion joint installation for a wall or ceiling, showing the expansion gap open.

The expansion joint shown in FIGS. 1 and 2 occurs between coplanar building wall or ceiling sections S1 and S2 on opposite sides of an expansion gap G, a condition that is commonly found where a corridor or room extends between two sections of a building that are structurally isolated by the expansion joint. The sections S1 and S2 move toward and away from each other due to thermal expansion and contraction and, in earthquake zones, due to motions of the building sections relative to each other caused by an earthquake. A rectangular cover member 10 of rigid material, which is shown in phantom lines in FIGS. 1 and 2, spans and covers the expansion gap and is suitably coupled to the sections S1 and S2, as described below.

The cover member 10 is retained with its side edges 10-1 and 10-2 substantially equidistant from the longitudinal center axis A of the expansion gap G for all widths of the expansion gap by a resilient centering system that includes a plurality of first tensioned flexible segments 12*a*, 12*b*, 12*c*, and 12*d* that extend obliquely between the section S1 and the cover member 10 and a plurality of second tensioned flexible segments 14*a*, 14*b*, 14*c* and 14*d* that extend obliquely between the section S2 and the cover member 10. Each tensioned flexible segment is connected at one end to the cover member 10 and at the other end to the respective section S1 or S2.

In the illustrated centering system, the tensioned flexible segments consist of two similar sets or groups, each having two first tensioned flexible segments and two second tensioned flexible segments extending mutually divergently from a common cover connection point at substantially the lateral center of the cover member at substantially equal angles with the longitudinal axis of the cover member and maintained under substantially equal tension by balancing of the force components exerted by the segments in a direction orthogonal to the axis A of the gap when the cover member is centered in the gap. For any given width of the gap G and with the cover member centered, the segments forming each group are symmetrically arranged. The groups, in particular, are: an upper group, which is composed of first segments 12*a* and 12*b* and second segments 14*a* and 14*b*, which are joined to the panel at a common connection point 16; and a lower group, which is composed of first segments 12*c* and 12*d* and second segments 14*c* and 14*d*, which are joined to the panel at a common connection point 18.

Referring to FIG. 4, each tensioned flexible segment of each group exerts a principal force $F_T$ that acts divergently away from the connection point C1 to the cover member along the direction in which the segment leads to a connection point (e.g., S1-1, S1-2, etc.) to a building member for any given width of the gap. Each principal force $F_T$ can be resolved into a component $F_A$ that acts axially (along the axis A) of the gap and a component $F_O$ that acts orthogonally to the axis A of the gap. As may be discerned from FIG. 5A, the orthogonal axial component $F_O$ is equal to $F_T\cos\alpha$, where $\alpha$ is the angle between the shock cord segment and a line orthogonal to the gap axis. If, for example, the cover tends to shift to the left with respect to FIGS. 4 or 5, the angle $\alpha$ will decrease (see FIG. 5B) and, assuming that the tension in the segment and therefore the principal force $F_T$ remains constant, the orthogonal force component will increase as a function of $\cos\alpha$. Referring again to FIG. 4, it can be observed that movement of the connection point C1 of the group of segments to the left will increase the angle $\alpha$ of the segments leading off to the left side section S1 and reduce the angle $\alpha$ of the segments leading off to the right side section S2. Therefore, the orthogonal force components $F_O$ acting on the connection point C1 to the left will be reduced and those leading to the right will be increased, thus producing a net force acting on point C1 to the right. The force imbalance is eliminated by movement of the connection point C1—and hence the cover member—to the right.

Several arrangements of centering systems based on shock cords are possible, and some of them are shown in FIGS. 6 to 10. In those figures, fixed connections between the shock cord segments and the building sections or the cover member are indicated by X's, and free connections, such as by pulleys, that allow the cord to slide relative to the connection point are indicated by O's.

Figure 6:
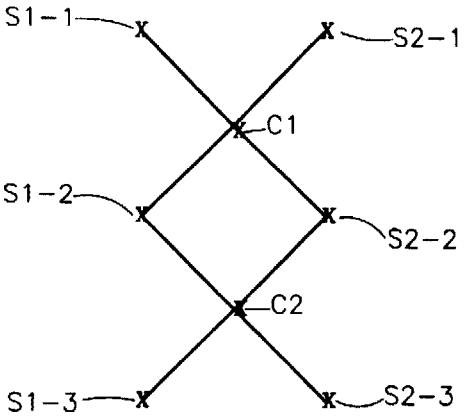
FIGS. 6 to 10 show schematically several possible arrangements of tensioned cords for a centering system for an expansion joint cover installation.

In the centering system of FIG. 6, two pieces of shock cord are fabricated into an assembly in which loops or hooks provide for fixed connection points S1-1, S1-2, S1-3, S2-1, S2-2 and S2-3 to the building sections and thimbles by which the assembly is attached to the cover member are affixed at connection points C1 and C2 with the cover member. In such an arrangement, each segment of shock cord between adjacent connection points acts independently. By initially assembling the system with predetermined spacings between adjacent connection points, a desired level of tension in each segment when the gap is at a minimum width is provided when the cover and centering system are installed. In such an arrangement, should the cover be displaced to the left (with reference to FIG. 6), for example, each segment leading from the cover to the left will diminish in length and the tension in it will be reduced correspondingly. Similarly, each segment leading to the right will be lengthened and the tension force in it will be increased. Recalling that the angles $\alpha$ of the left segments increase and those to the right decrease when the cover is to the left of center, thus reducing the orthogonal force components in the left segments and increasing those in the right segments, the net forces exerted on the cover to the right by the centering system are increased in two ways: first, by changes in tension in the segments as they change in length, and second, by changes in the orthogonal force components. In an arrangement of shock cords in which all connection points are fixed, the paths of pieces of cord may be either:

First cord piece: S1-1, C1, S1-2, C2, S1-3.

Second cord piece: S2-1, C1, S2-2, C2, S2-3.

or:

First cord piece: S1-1, C1, S2-2, C2, S1-3.

Second cord piece: S2-1, C1, S1-2, C2, S2-3.

A mix of the above two routings is also possible. Or one may wish to fabricate assemblies of two cords with a loop or hook at each end and a thimble for attachment to a connection point C to the cover member.

Figure 7:
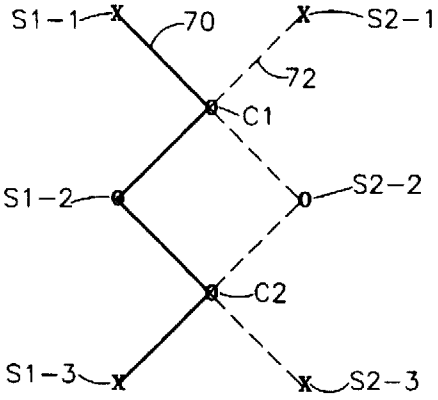

In FIG. 7, a first piece of shock cord 70 runs from a fixed point S1-1, passes freely through connections at C1, S1-2 and C2 and is fixed at S1-3. A second piece 72 is fixed at S2-1, passes freely through connections at C1, S2-2 and C2 and is fixed at S2-3. In this case, each cord self-adjusts by movements at the free connections to uniform tension upon installation. Inasmuch as the segments connected to the right section are independent of those connected to the left section, a force imbalance between the left and right sides when the cover member is not centered consists partly of an imbalance due to a difference in tension between the right and left cord segments as they change lengths and a difference between the angles $\alpha$ of the right and left cord segments. Accordingly, the centering system of FIG. 7 functions in essentially the same way as that of FIG. 6.

Figure 8:
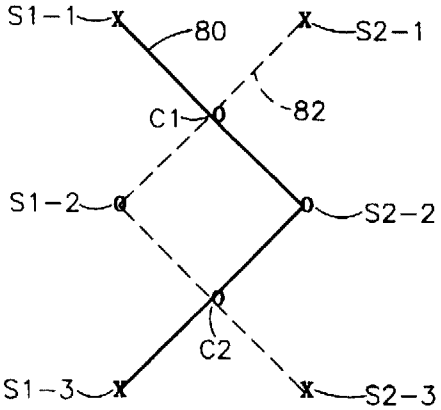

The system shown schematically in FIG. 8 consists of a first piece of shock cord 80 that is fixed at connection S1-1, runs freely through connections C1, S2-2, and C2, and is fixed at connection S1-3. A second piece 82 is fixed at S2-1, runs freely through C1, S1-2, and C2 and is fixed at S2-3. In this case, when the cover is not centered, both cord pieces are extended but by equal amounts. For any given off-center position of the cover, the tensions in both cords are equal. Accordingly, a force imbalance is due only to a difference in the angle α between the right and the left sides of the cord system. The arrangement of FIG. 8 is possible but not as desirable as those of FIGS. 6 and 7, inasmuch as the effect of changes in the tensions in the cord segments to provide a centering force is lacking.

Figure 9:
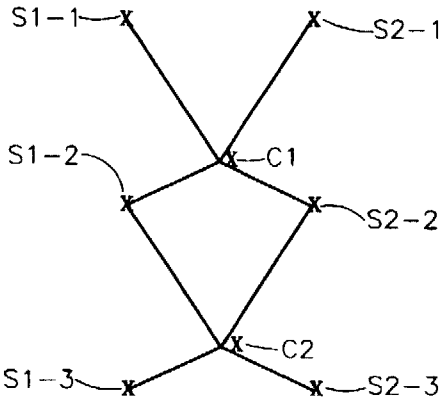

FIG. 9 shows an arrangement suitable for a wall expansion joint cover. It is similar to those of FIGS. 6 and 7, except that each cover connection point C1 and C2 is closer axially to the building section connection points below it than those above it. Accordingly, the angles α of the cord segments that extend up from each point C1 and C2 are greater than the angles α of the cord segments that extend down. The axial components $F_A$ are equal to $F_T \sin\alpha$. Therefore, each connection point C1 and C2 is subject at all times to a net axial force due to the tensions in cord segments upwardly, which can partly or fully offset the downward force of the cover member due to its weight and thus reduce friction in sliding couplings of the cover to the sections. The centering forces for maintaining the cover member centered in the gap result from both a difference in tension in the segments on the right and left and differences in the various angles α and the right and left. A result similar to that of the configuration of FIG. 9 can be obtained by making only one group of cord segments (associated with either connection C1 and C2) angularly asymmetrical with respect to the orthogonal direction. Also, the arrangement of FIG. 6 (all cord connection points fixed at assembly) can be altered to provide a net force due to cord tensions in the axial direction by having the tensions in cord segments that extend up from one or both connection points C1 and C2 greater than the tensions in those that extend down.

Figure 10:
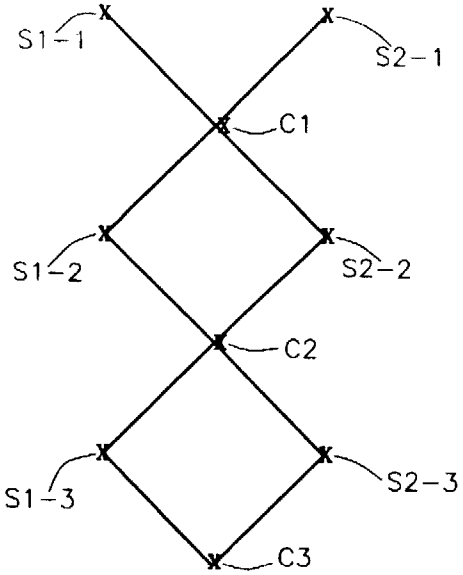

FIG. 10 shows another way of providing a net axial force up on a wall joint cover, namely by providing additional shock cord segments that diverge upwardly and outwardly from a cover connection point C3 to building section connection points S1-3 and S2-3.

The cover members are, preferably, either rigid panels or extensible panels and can be coupled to wall or ceiling sections S1 and S2 in numerous ways. In most cases, a rigid cover member is coupled in sliding relation orthogonally and in fixed relation axially to retainers of a suitable design that are installed on the building members on either side of the expansion gap G. Extensible panels are, likewise, coupled to retainers but in a fixed relation.

Figure 3:
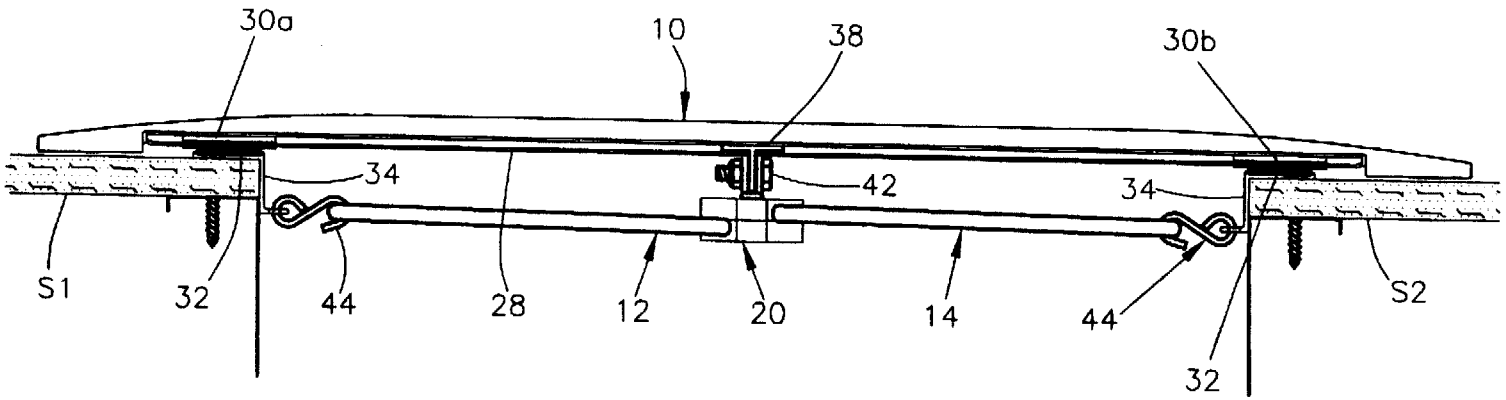
FIG. 3 is an end elevational view of an expansion joint installation that has as a cover member a rigid panel and incorporates a slidable, releasable surface mounting arrangement for coupling the cover to the building sections.

The rigid panel cover 10 of FIG. 3 and the manner by which it is coupled to the sections S1 and S2 are known per se and are described and shown in U.S. patent application Ser. No. 08/340,036, filed Nov. 14, 1994 [allowed and issue fee paid], which is hereby incorporated by reference. Briefly, the cover 10 is compression-molded from a composite material, which contains fibers, such as glass fibers, bonded by a resin binder. The cover is of uniform profile in transverse cross-section along its length and is thicker at its center than along the edges so as to present a slightly convexly curved external surface. The relatively thin edges and the smooth curvature present a "thinline" appearance to an observer. A heavy paper of the type used on gypsum wallboard covers the exposed surfaces of the cover so that the surfaces can be painted or wallpapered to match or coordinate with the wall surfaces.

Transversely extending recesses are molded into the internal or back surface of the cover 10 at suitable intervals along its length. Each recess receives a slide track 28, which is generally channel-shaped and includes a flange portion along each side that forms an undercut groove. The slide tracks 28 may be pieces cut from an extrusion of metal or plastic or from a brake-formed or roll-formed metal band and are suitably fastened to the cover 10 such as by adhesive bonding. Each slide track is somewhat longer than the width of the expansion gap and receives a pair of sliders **30*a* and 30*b*, which are, preferably, pieces cut from an extrusion of a polymeric material, such as polyvinyl chloride, and are shaped and dimensioned in cross section so as to be retained in the slide track 28** and to slide along the slide track.

A piece of one element of a hook and loop fastener 32 is fastened, such as by adhesive bonding, to a leg portion of each retainer 34 at each location along the length of the retainer that is crossed by a slide track 28 of the cover. A piece of the other element of the hook and loop fastener 32 is attached, such as by adhesive or thermal bonding, to each slider **30*a*, 30*b***. A suitable hook and loop fastener is available from 3M Industrial Tape and Specialties Division of St. Paul, Minn., as Type 400 "Dual Lock" reclosable fastener. Both elements of that fastener have mushroom-like stems that interengage to provide a highly tenacious releasible connection. The stems are also durable and can be released and refastened numerous times with no significant loss of tenacity. While less preferred, magnets and gravity clips can be substituted for hook and loop fasteners.

Two of the slide tracks 28 are positioned coincidentally with the attachment points 16 and 18 (FIG. 1) of the centering system. Each of those tracks receives in a fixed, centered position a clip 38 to which a thimble 20 may be releasably attached, such as by a nut and bolt 42.

Installing the expansion joint cover is quick and easy. The tension cords 12, 14, thimbles 20 (or pulleys) and S-hooks 44 arrive on the job site as subassemblies that are either already connected to the cover or are connected to the cover at the site. The hook and loop cloth elements are fastened in place on the retainers and sliders. The cover 10 is held in generally overlying relation to the gap but away from it to leave space between the side edges of the cover and the wall or ceiling sections S1 and S2 for a worker to reach in from the sides and attach the hooks 44 on the shock cords to the building connection points, which are provided on the retainers. There are generally only six such connections to be made. The shock cord is relatively easily stretched to make each connection. The sliders **30*a*, 30*b* are adjusted to the correct spacing so that they register with the hook and loop elements on the retainer. Pushing the cover firmly toward the wall along each side sets the hook and loop fasteners 32**.

Movements of the sections S1 and S2 relative to the cover 10 occur with minimal resistance from the sliders **30*a* and 30*b*, which run easily in the tracks 28. Any tendency for the cover to move off center of the gap is prevented by the shock cord centering system by equalization of the tensions in the segments 12*a* to 12*d* and 14*a* to 14*d* and equalization of the angles between the center axis of the gap and the segments of the shock cords on both sides of the gap, as described above. With the preferred arrangement of FIG. 6**, for example, if the cover is not centered, the shock cord connected to the building structure that is closer to the center of the cover member will be under less tension than the other shock cord, and the segments of those shock cord segments will be at greater angles α, thus making the orthogonal force components less than those of the other cord. The two effects (tension and angle differences) combine to produce a force imbalance, which is eliminated by movement of the cover member to center to balance the tensions in the cords and equalize the angles of the segments.

The shock cords 12 and 14 also accommodate large movements of the building members in all directions that result from an earthquake. The hook and loop connections 32 between the cover 10 and the building sections S1 and S2 allow the cover to release from the retainers upon large movements in various relative directions. The tensioned flexible segments serve as tethers to keep the cover from falling to the floor and becoming an obstruction to building occupants.

Figure 11:
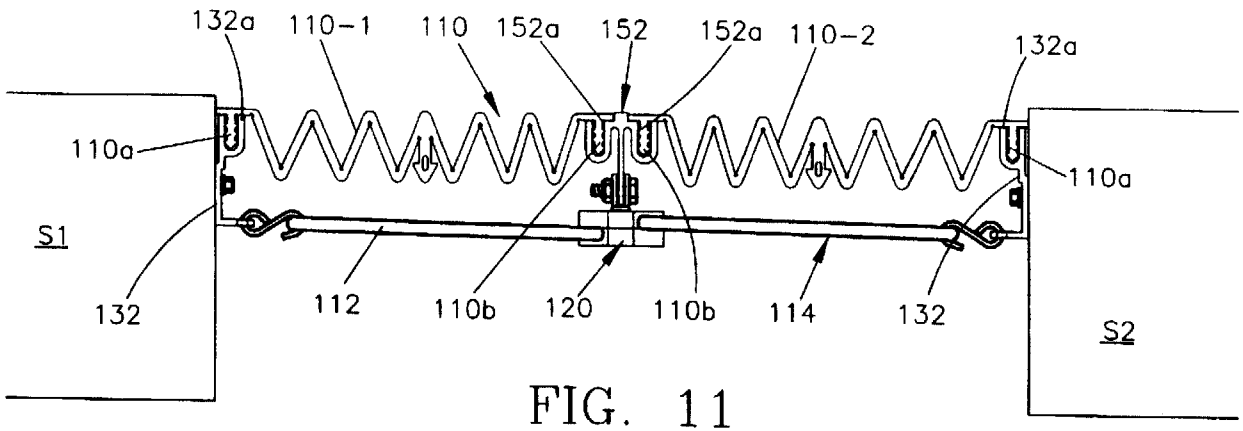
FIG. 11 is an end elevational view of an expansion joint installation having an extensible cover member.

FIG. 11 shows an expansion joint cover installation of a type that is commonly used at the gaps between the exterior walls of building structures but that can also be used on interior walls and ceilings. The centering system is the same as that of FIGS. 1 to 3, and may be varied as shown in FIGS. 6 to 10. Similar parts are assigned the same reference numerals as those of FIGS. 1 to 3, but increased by 100. The cover 110, which is known per se, consists of two panels 110-1 and 110-2 of a polymeric material that have pleats or corrugations extending parallel to the axis of the gap. Serrated tongues 110*a* along one edge of each panel and received in grooves 132*a* of retainers 132 affix the panels to the building structures S1 and S2. An elongated connector strip 152 joins the two panels at the center of the gap by means of tongues 110*b* and grooves 152*a* and provides for attachment of thimbles 120 to the two-panel unit formed by the interconnected panels. Widening and narrowing of the gap G is accommodated by extension and retraction of the panels 110-1 and 110-2 orthogonally to the pleats. The centering system of shock cords 112 and 114 holds the connector strip 152 centered in the expansion gap throughout the range of widths.

Figure 12:
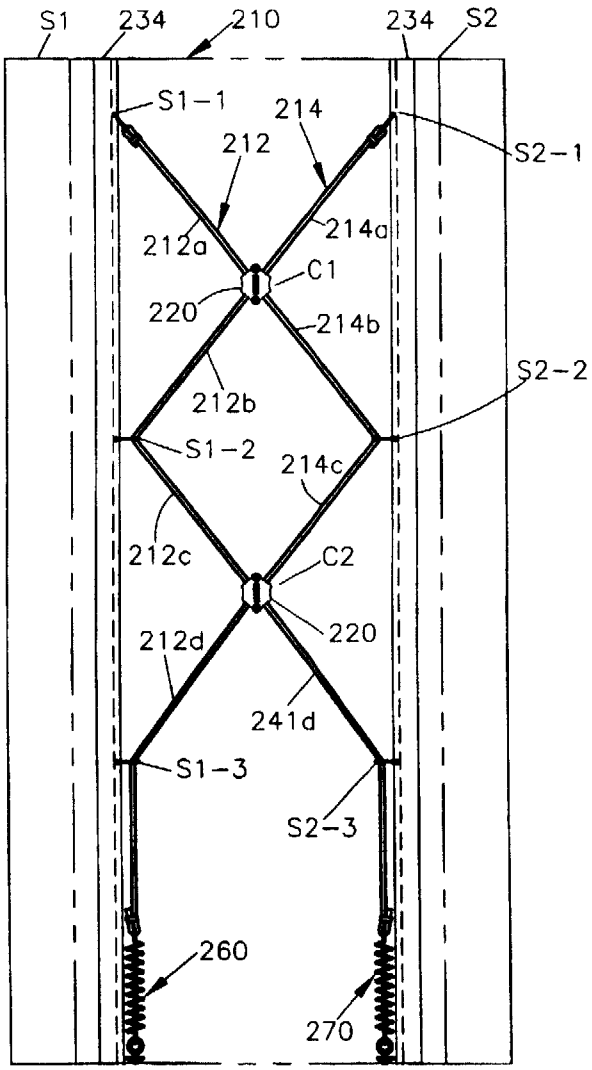

The centering system of FIG. 12 is similar to that of FIGS. 1 and 2 and may be used with cover members 210 of various designs and coupled in various ways to the building structures S1 and S2, generally by means of retainers 234 affixed to the building structures. A first steel cable 212 extends along the following path: a fixed connection point S1-1 to the structure S1; obliquely along a segment 212*a* to an attachment thimble 220 that is affixed to the cover member 210 at attachment point C1; obliquely along a segment 212*b* to a second attachment point S1-2 to the structure S1; obliquely along a segment 212*c* to an attachment thimble 220 that is affixed at connection point C2 to the cover member 210; obliquely along a segment 212*d* to a third connection point S1-3 to the structure S1; and vertically down to one end of a metal coil tension spring 260, to which the cable end is attached. The other end of the tension spring is affixed to the building member S1 and is installed so as to be under a predetermined minimum tension when the expansion gap is at its narrowest. A second steel cable 214 extends along a path that is symmetrical to that of the first cable 212, thus running along a zig-zag path between connections points S2-1, S2-2 and S2-3 to the building member and connection points C1 and C2 to the thimbles 220. The second cable is tensioned by a spring 270.

As the expansion gap narrows and widens and with the cover 210 centered, the springs 260 and 270 maintain substantially equal tension in the cables for any given width of the gap. The cover member is kept centered in the gap by moving relative to the structures S1 and S2 to eliminate any imbalance between the orthogonal force components applied to the segments of the tensioned cables 212 and 214 by the tension springs. As in the embodiment of FIGS. 1 to 3, the segments of each cable 212 and 214 form substantially equal angles α with the center longitudinal axis of the cover member for any given width of the gap.

The cables 212 and 214 are of necessity movably coupled to the thimbles 220 and at the connection points S1-2, S1-3, S2-2 and S2-3 so that each cable remains tensioned for all widths of the expansion gap. Advantageously, pulleys are used at the connection points where the cable movably engages the cover member and the building structures so that the cable will run freely at those points and ensure that the orthogonal force components balance by centering of the cover member in the event of any imbalance.

Figure 13:
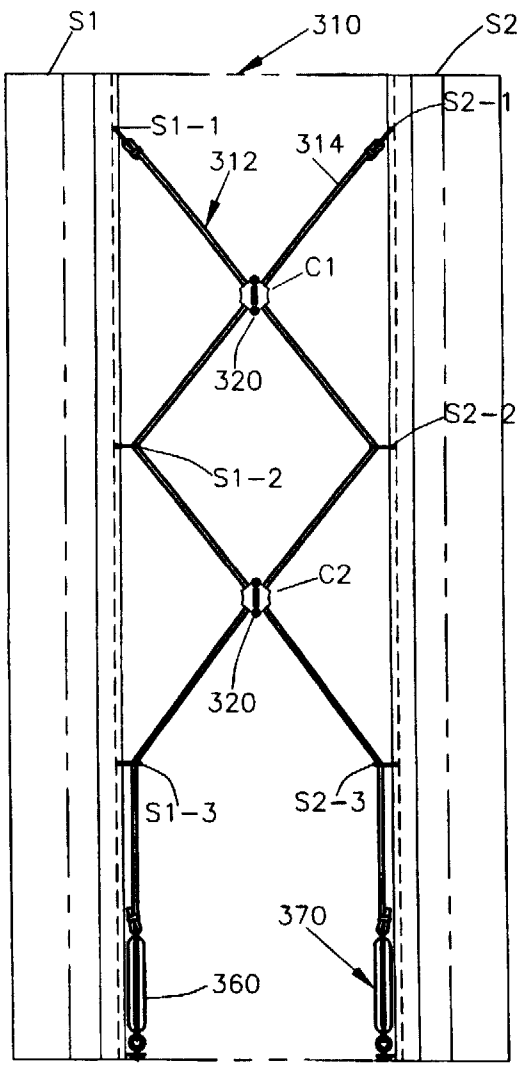
FIGS. 12, 13 and 14 are elevational views of expansion joint installations having different forms of tensioned flexible segments.

The embodiment shown in FIG. 13 is the same as that of FIG. 12, except for the substitution for tension metal coil springs of doubled loops of shock cord 360 and 370 for tensioning the cables 312 and 314. The reference numerals of FIG. 12, increased by 100, are used in FIG. 13.

In each of the embodiments of FIGS. 12 and 13, the tension springs can be inserted anywhere along the paths of the cables, but it is convenient to have them at one end or the other, thus allowing a single length of cable to be used for each side of the gap. Two springs for each cable, such as one at each end, are also possible.

In the embodiments of FIGS. 12 and 13, the cable associated with the building section S1 is tensioned independently of the cable associated with the building member S2. Accordingly, a net force acting to center an off center cover member results from both a difference in the tensions of the two cables and a difference in the angles α to the left and right of the axis A.

It is also possible to have the cable paths of the embodiments of FIG. 12 and 13 correspond to the one shown in FIG. 7. In that case, each cable is maintained under the same tension for any given width of the gap and degree of off-center of the cover member. Therefore, a net force tending to restore an off-center cover member to center results only from differences between the angles α to the right and left of the connection points C1 and C2. The arrangement of FIG. 7 is possible but not as desirable as that of FIGS. 12 and 13.

Figure 14:
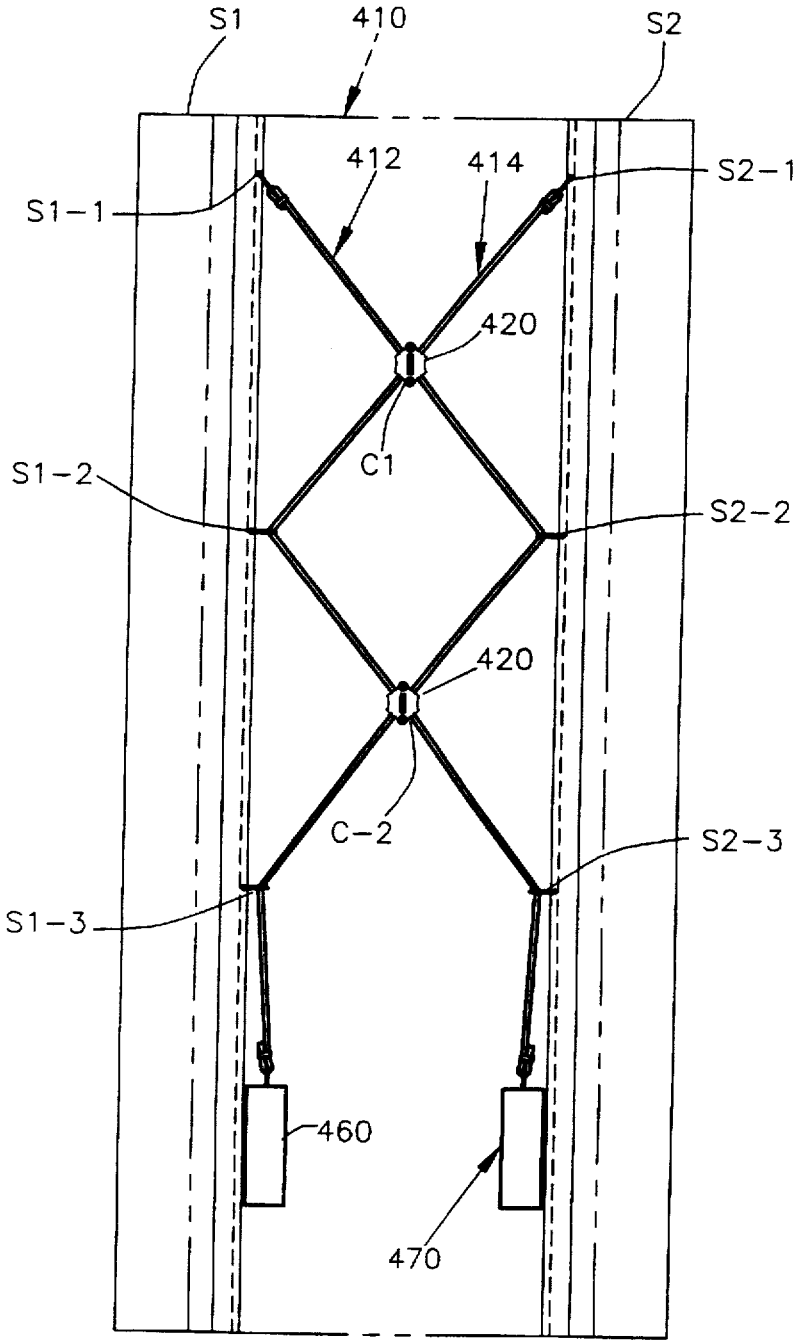

In FIG. 14, the same reference numerals as used in FIG. 12 are applied to similar components, but increased by 200. Cables 412 and 414 are maintained under tension by weights 460 and 470. The tensioning forces exerted on the cables by the weights are constant for all widths of the gap. If the cover member 410 is not centered, the force components orthogonal to the axis A of the gap will be greater in the segments that are on the side of the gap to which the center of the cover is closer than in the segments on the other side because of a difference in the angles α of the segments to the right and left of the connection points C1 and C2. The imbalance of forces will be restored by displacement such that the angles α of the segments on either side of the center of the cover are equalized, thereby making the orthogonal force components equal.

Figure 15:
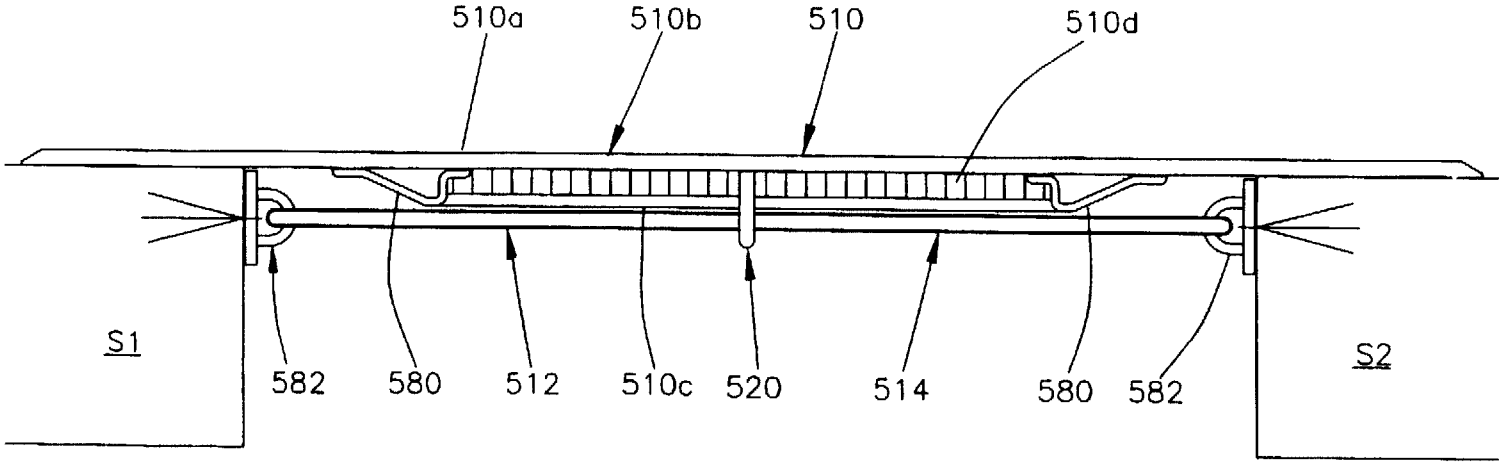
FIG. 15 is an end elevational view of an expansion joint cover installation for a floor joint.

An exemplary floor joint installation, as shown in FIG. 15, consists of a cover 510, which is built up from a metal bridge plate 510*a* and a stiffener section 510*b* joined to the center portion of the bridge plate, and a centering system, which consists of steel cables 512 and 514 maintained under a high tension. Such as by strong mechanical springs or heavy weights (not shown). As mentioned above, the centering system must exert forces on the cover plate sufficient to keep it from shifting when persons walk on it or carts or the like are moved across it. The stiffener section consists of a second plate 510*c* and a core 510*d*, such as a honeycomb or composite material, sandwiched between and bonded to the bridge plate 510*a* and the second plate 510*c*. Deflectors 580, which may be longitudinally continuous or segmented lengthwise, are fastened to the bridge plate. The cables 512 and 514 may be trained along the paths described above between coupling members 520 fastened to the cover 510 and anchors 582 secured to the floor sections S1 and S2 on the opposite sides of the expansion gap.

FIG. 15 shows the expansion joint in its normal state. Portions along each edge of the bridge plate 510 rest on the surfaces of the floor sections S1 and S2. The expansion gap can widen and narrow due to thermal expansion, and the bridge plate will remain in the condition shown for a range of widths of the expansion gap. The centering system retains the cover 510 centered with respect to the longitudinal axis of the expansion gap as the gap widens and narrows.

In an earthquake, the gap will open and close to an extent considerably greater than it does under thermal expansion and contraction. When the gap widens, the edge portions of the cover 510 continue to be supported by the floor sections S1 and S2, the cover being held centered in the gap by the centering system. When the gap narrows, the deflectors 580 push the cover 510 upwardly by camming actions against the corners of the section S1 and S2 that they engage, thus moving the stiffening section upwardly so that it cannot make contact with the section S1 and S2 as the gap narrows. The cables 512 and 514 yield resiliently to allow the cover to be pushed upwardly. The centering system allows motions of the floor sections in all three principal axes (longitudinally of the gap, orthogonally of the gap, and vertically) relative to each other due to the flexibility and yieldability of the cable/spring system. At the same time, the centering system keeps the cover substantially centered transversely of the expansion gap. Accordingly the gap remains covered in an earthquake, and persons and objects can move across it, if necessary, and cannot fall through the gap.

In any of the embodiments of FIGS. 12 to 15, the wire cable can be plastic-coated or sheathed in a plastic cover. Cords or ropes of synthetic fiber material can be used instead of wire cable.

In any of the embodiments described above, additional segments of cord, rope, or cable with connection points to the building sections and the cover member can be added. A single group of four segments at or near the axial center of the cover is also possible.

We claim:

1. An expansion joint cover installation comprising:

first and second building members defining an expansion gap between them, the expansion gap having a central axis and being of variable width due to movements of the building members;

a cover member spanning and covering the expansion gap and coupled to the building members, the cover member having parallel side edges and a rear surface; and resilient centering means coupled between the building members and the rear surface of the cover member for retaining the cover member centered in the gap with its side edges substantially equidistant from the axis of the expansion gap for all widths of the expansion gap, the resilient centering means including a plurality of first tensioned flexible segments connected obliquely between the first building member and the cover member, and a plurality of second tensioned flexible segments connected obliquely between the second building member and the cover member.

2. An expansion joint cover installation according to claim 1 wherein there are two first tensioned flexible segments and two second flexible tensioned segments extending mutually divergently from a common cover connection point at substantially the lateral center of the cover member, the segments being at substantially equal angles with the longitudinal axis of the cover member and maintained under substantially equal tension for any given width of the gap and with the cover centered in the gap.

3. An expansion joint cover installation according to claim 1 wherein the first tensioned flexible segments are portions of a first continuous tensioned flexible member that extends along a zig-zag path between spaced-apart building connection points where the first continuous tensioned flexible member is connected to the first building member and spaced-apart cover connection points where the first continuous tensioned flexible member is connected to the cover member; and the second tensioned flexible segments are portions of a second continuous tensioned flexible member that extends along a zig-zag path between spaced-apart building connection points where the second continuous tensioned flexible member is connected to the second building member and spaced-apart cover connection points where the second continuous tensioned flexible member is connected to the cover member.

4. An expansion joint cover installation according to claim 3 wherein the segments of the first and second tensioned flexible members form substantially equal angles with the axis of the expansion gap and are maintained under substantially equal tension for any given width of the expansion gap and with the cover centered in the gap.

5. An expansion joint cover installation according to claim 3 wherein the paths of the first and second continuous tensioned flexible members are substantially symmetrical with respect to the axis of the expansion gap.

6. An expansion joint cover installation according to claim 1 wherein the first and second tensioned flexible segments are elastic cords.

7. An expansion joint cover installation according to claim 3 wherein the first and second tensioned flexible members are elastic cords, each of which is affixed at its ends to a corresponding building member.

8. An expansion joint cover installation according to claim 3 wherein each of the first and second continuous tensioned flexible members includes a substantially nonelastic strand and means for tensioning the strand.

9. An expansion joint cover installation according to claim 3 wherein each of the first and second continuous tensioned flexible members includes a substantially nonelastic strand and means for tensioning the strand, each strand being affixed at one end to the respective building member, being tensioned at the other end by the tensioning means, and being movably connected to the building member and the cover member at the ends of each segment except for the affixed end and the tensioned end.

10. An expansion joint cover installation according to claim 9 wherein the tensioning means is a tension spring.

11. An expansion joint cover installation according to claim 9 wherein the tensioning means is a weight.

12. An expansion joint cover installation according to claim 1 wherein the cover member is a substantially rigid panel and is coupled to the building members in a fixed relation relative to the axis of the gap and in a slidable relation orthogonally of the axis of the gap.

13. An expansion joint cover installation according to claim 12 wherein the cover member includes a substantially rigid sheet of a fiber-reinforced resin.

14. An expansion joint cover installation according to claim 12 wherein the cover member includes at least two transverse tracks spaced apart longitudinally with respect to the axis of the expansion gap, two slide members slidably received in each track, and releasible fasteners having one element attached to each slide member and another element affixed to a corresponding building member.

15. An expansion joint cover installation according to claim 1 wherein the cover member includes at least one sheet of a polymeric material having corrugations extending substantially parallel to the axis of the expansion gap and is affixed along its side edges to the respective building members.

16. An expansion joint cover installation comprising:

first and second building members defining an expansion gap between them, the expansion gap having a central axis and being of variable width due to movements of the building members;

a cover member spanning and covering the expansion gap and coupled to the building members, the cover member having parallel side edges; and resilient centering means coupled between the building members and the cover member for retaining the cover member centered in the gap with its side edges substantially equidistant from the axis of the expansion gap for all widths of the expansion gap, the resilient centering means including a first continuous tensioned flexible member connected alternately with respect to its length to the first building member and to the cover member such as to form at least four segments extending obliquely at substantially equal angles with respect to the axis of the expansion gap between the first building member and the cover member; and a second continuous tensioned flexible member connected alternately with respect to its length to the second building member and to the cover member such as to form at least four segments extending obliquely at substantially equal angles with respect to the axis of the expansion gap between the second building member and the cover member, the segments of the first and second tensioned continuous flexible members being oriented substantially symmetrically with respect to the axis of the expansion gap and being retained under substantially equal tensions for any given width of the expansion gap and with the cover centered in the gap.

17. An expansion joint cover installation according to claim 16 wherein each of the first and second continuous tensioned flexible members includes a substantially non-elastic strand and means for tensioning the strand.

18. An expansion joint cover installation according to claim 16 wherein each of the first and second continuous tensioned flexible members includes a substantially non-elastic strand and means for tensioning the strand, each strand being affixed at one end to the respective building member, being tensioned at the other end by the tensioning means, and being movably connected to the building member and the cover member at the ends of each segment except for the affixed end and the tensioned end.

19. An expansion joint cover installation according to claim 18 wherein the tensioning means is a tension spring.

20. An expansion joint cover installation according to claim 18 wherein the tensioning means is a weight.

21. An expansion joint cover installation according to claim 16 wherein the cover member is a substantially rigid panel and is coupled to the building members in a fixed relation axially of the gap and in a slidable relation orthogonally of the gap.

22. An expansion joint cover installation according to claim 21 wherein the cover member includes a substantially rigid sheet of a fiber-reinforced resin.

23. An expansion joint cover installation according to claim 21 wherein the cover member includes at least two transverse tracks spaced apart longitudinally with respect to the axis of the expansion gap, two slide members slidably received in each track, and releasible fasteners having one element attached to each slide member and another element affixed to a corresponding building member.

24. An expansion joint cover installation according to claim 16 wherein the cover member includes at least one sheet of a polymeric material having corrugations extending substantially parallel to the axis of the expansion gap and is affixed along its side edges to the respective building members.

25. An expansion joint cover installation comprising:

first and second building members defining an expansion gap between them, the expansion gap having a central axis and being of variable width due to movements of the building members;

a cover member spanning and covering the expansion gap and coupled to the building members, the cover member having parallel side edges; and resilient centering means coupled between the building members and the cover member for retaining the cover member with its side edges substantially equidistant from the axis of the expansion gap for all widths of the expansion gap, the resilient centering means including a first continuous tensioned flexible member having segments connected obliquely between the first building member and the cover member, and a second continuous tensioned flexible member having segments connected obliquely between the second building member and the cover member, the first continuous tensioned flexible member being connected alternately with respect to its length to the first building member and to the cover member proximate to the transverse center of the cover member such as to form at least four segments extending obliquely at substantially equal angles with respect to the axis of the expansion gap between the first building member and the cover member; and the second continuous tensioned flexible member being connected alternately with respect to its length to the second building member and to the cover member proximate to the transverse center of the cover member such as to form at least four segments extending obliquely at substantially equal angles with respect to the axis of the expansion gap between the second building member and the cover member, the segments of the first and second continuous tensioned flexible members being oriented substantially symmetrically with respect to the axis of the expansion gap and being retained under substantially equal tensions for any given width of the expansion gap and with the cover member centered in the gap.

26. An expansion joint cover installation according to claim 25 wherein the segments of the first and second continuous tensioned flexible members are connected to the cover members by thimbles, and each thimble is releasably connected to the cover member.

27. An expansion joint cover installation according to claim 26 wherein each thimble connects two adjacent segments of each of the first and second continuous tensioned flexible members to the cover member.

28. An expansion joint cover installation according to claim 27 wherein the cover member includes a substantially rigid sheet of a fiber-reinforced resin and is coupled to the building members in a sliding relationship, and wherein the cover member includes at least two transverse tracks spaced apart longitudinally with respect to the axis of the expansion gap, two slide members slidably received in each track, and releasible fasteners having one element attached to each slide member and another element affixed to a corresponding building member, and wherein each track receives a fixed thimble bracket to which a thimble is releasably attached.

29. An expansion joint cover installation according to claim 25 wherein the cover member includes two strips of a polymeric material, each having corrugations extending substantially parallel to the axis of the expansion gap, and a medial retainer to which one side edge of each strip is attached, the other edge of each strip being affixed along its side edges to the respective building members, and wherein the thimbles are releasably attached to the medial retainer of the cover member.

* * * * *

UNITED STATES PATENT AND TRADEMARK OFFICE

CERTIFICATE OF CORRECTION

PATENT NO. : 5,799,456

DATED : September 1, 1998

INVENTOR(S) : Thomas A. Schreiner, et al.

It is certified that error appears in the above-identified patent and that said Letters Patent is hereby corrected as shown below:

COVER PAGE:

[57] U.S. PATENT DOCUMENTS:

"5,644,879 7/1997 Shrein et la." should read --5,644,879 7/1997 Schreiner et al.

Column 2, line 18, "coup led" should read --coupled--.

Column 11, line 47, Claim 1, "edges and" should read --edges, a lateral center, a longitudinal axis, and--;

line 50, Claim 1, "its" should read --the--;

line 59, Claim 2, "An" should read --The--.

UNITED STATES PATENT AND TRADEMARK OFFICE

CERTIFICATE OF CORRECTION

PATENT NO. : 5,799,456
DATED : September 1, 1998
INVENTOR(S) : Thomas A. Schreiner, et al.

It is certified that error appears in the above-identified patent and that said Letters Patent is hereby corrected as shown below:

Column 12, line 1, Claim 3, "An" should read --The--;

line 17, Claim 4, "An" should read --The--;

line 19, Claim 4, "tensioned" should read --continuous tensioned--;

line 23, Claim 5, "An" should read --The--;

line 27, claim 6, "An" should read --The--;

line 30, Claim 7, "An" should read --The--;

line 32, Claim 7, "at its" should be deleted;

line 33, Claim 7, "ends" should be deleted; "a corresponding" should read -- one of the --; and "member." should read -- members. --;

line 34, Claim 8, "An" should read -- The --;

line 39, Claim 9, "An" should read -- The --;

line 42, Claim 9, "the respective" should read -- one of said --;

line 43, Claim 9, "member," should read --members,--;

UNITED STATES PATENT AND TRADEMARK OFFICE

CERTIFICATE OF CORRECTION

PATENT NO. :5,799,456

DATED :September 1, 1998

INVENTOR(S) :Thomas A. Schreiner, et al.

It is certified that error appears in the above-identified patent and that said Letters Patent is hereby corrected as shown below:

line 46, Claim 9, "end." should read -- end of the strand. --;

line 47, Claim 10, "An" should read -- The --;

line 49, Claim 11, "An" should read -- The --;

line 51, Claim 12, "An" should read -- The --;

line 56, Claim 13, "An" should read -- The --;

line 59, Claim 14, "An" should read -- The --; line 63, Claim 14, "having" should read -- each including two elements, --;

line 64, Claim 14, "another" should read -- the other --;

line 65, Claim 14, "a corresponding" should read -- one of said -- and "member." should read -- members. --;

line 66, Claim 15, "An" should read -- The --;

UNITED STATES PATENT AND TRADEMARK OFFICE

CERTIFICATE OF CORRECTION

PATENT NO. : 5,799,456
DATED : September 1, 1998
INVENTOR(S) : Thomas A. Shreiner, et al.

It is certified that error appears in the above-identified patent and that said Letters Patent is hereby corrected as shown below:

Column 13, line 3, Claim 15, "its" should read -- said --, "the" should read -- one of the -- and "respective" should be deleted;

line 15, Claim 16, "its" should read -- said --;

line 20, Claim 16, "with respect to its length" should be deleted;

line 27, Claim 16, "with respect to its length" should be deleted;

line 39, Claim 17, "An" should read -- The --;

line 43, Claim 18, "An" should read -- The --;

line 47, Claim 18, "the respective" should read -- one of said --;

line 48, Claim 18, "member," should read -- members, --;

line 51, Claim 18, "end." should read -- end of the strand. --;

line 52, Claim 19, "An" should read -- The --;

line 54, Claim 20, "An" should read -- The --;

UNITED STATES PATENT AND TRADEMARK OFFICE

CERTIFICATE OF CORRECTION

PATENT NO. : 5,799,456
DATED : September 1, 1998
INVENTOR(S) : Thomas A. Shreiner, et al.

It is certified that error appears in the above-identified patent and that said Letters Patent is hereby corrected as shown below:

line 56, Claim 21, "An" should read -- The --;

line 61, Claim 22, "An" should read -- The --;

line 64, Claim 23, "An" should read -- The --;

Column 14, line 1, Claim 23, "having" should read -- each including two elements, --;

line 2, Claim 23, "another" should read -- the other --.

line 3, Claim 23, "a corresponding" should read -- one of said -- and "member should read -- members. --;

line 4, Claim 24, "An" should read -- The --;

line 8, Claim 24, "its" should read -- said --, "the" should read -- one of the -- and "respective" should be deleted;

line 17, Claim 25, "edges; and" should read -- edges and a transverse center; and --;

line 20, Claim 25, "its" should read -- said --;

line 30, Claim 25, "with respect to its length" should be deleted;

line 38, Claim 25, "with respect to its length" should be deleted;

line 52, Claim 26, "An" should read -- The --;

UNITED STATES PATENT AND TRADEMARK OFFICE

CERTIFICATE OF CORRECTION

PATENT NO. : 5,799,456

DATED : September 1, 1998

INVENTOR(S) : Thomas A. Shreiner, et al.

It is certified that error appears in the above-identified patent and that said Letters Patent is hereby corrected as shown below:

line 55, Claim 26, "members" should read --member--;

line 57, Claim 27, "An" should read -- The --;

line 61, Claim 28, "An" should read -- The --.

Column 15, line 1, Claim 28, "having" should read -- each including two elements, --;

line 2, Claim 28, "another" should read -- the other -- and "a correspond-" should read --one of said--;

line 3, Claim 28, "ing" should be deleted and "member," should read -- members,--;

line 6, Claim 29, "An" should read -- The --;

UNITED STATES PATENT AND TRADEMARK OFFICE

CERTIFICATE OF CORRECTION

PATENT NO. : 5,799,456

DATED : September 1, 1998

INVENTOR(S) : Thomas A. Schreiner, et al.

It is certified that error appears in the above-identified patent and that said Letters Patent is hereby corrected as shown below:

line 8, Claim 29, "each having corrugations" should read -- each strip having two side edges and corrugations --;

line 3, Claim 29, "its" should read -- said --;

line 4, Claim 29, "the" should read -- one of the -- and "respective" should be deleted.

Signed and Sealed this

Tenth Day of October, 2000

*Attest:*

Q. TODD DICKINSON

*Attesting Officer*

*Director of Patents and Trademarks*